United States Patent [19]

Campbell, Jr.

[11] 4,269,107

[45] May 26, 1981

[54] LIQUID PROPELLANT/REGENERATIVE CHARGING SYSTEM BUBBLE PREVENTER

[75] Inventor: John Campbell, Jr., Woodland Hills, Calif.

[73] Assignee: The United States of America as represented by the Secretary of the Air Force, Washington, D.C.

[21] Appl. No.: 50,273

[22] Filed: Jun. 19, 1979

[51] Int. Cl.[3] ..... F41F 1/04

[52] U.S. Cl. ..... 89/7

[58] Field of Search ..... 89/1 R, 7, 11

[56] References Cited

U.S. PATENT DOCUMENTS

| | | | |
|---|---|---|---|
| 3,138,990 | 6/1964 | Jukes et al. | 89/7 |
| 3,763,739 | 10/1973 | Tassie | 89/7 |
| 4,099,445 | 7/1978 | Singelmann et al. | 89/7 |
| 4,100,836 | 7/1978 | Hofmann | 89/7 |

*Primary Examiner*—David H. Brown

*Attorney, Agent, or Firm*—Donald J. Singer; Robert Kern Duncan

[57] ABSTRACT

By angling the propellant fluid inlet to the charging chamber of a liquid propellant gun and having a central vent, the tangential swirling of the entering fluid clears the chamber and the fluid of entrapped gas.

1 Claim, 2 Drawing Figures

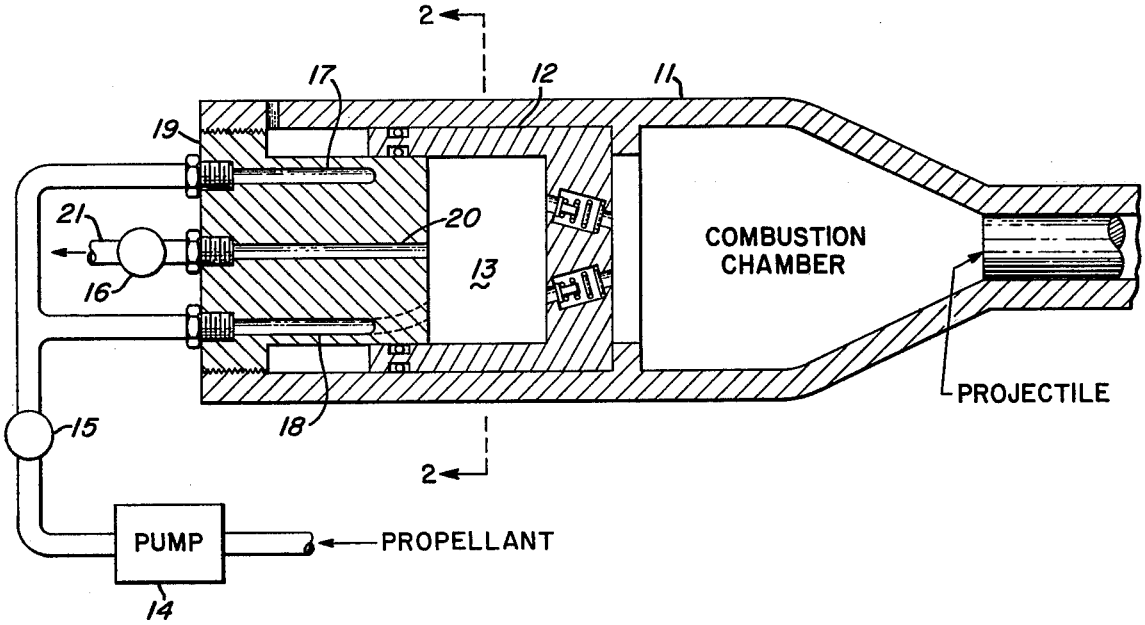
FIG. 1
FIG. 2
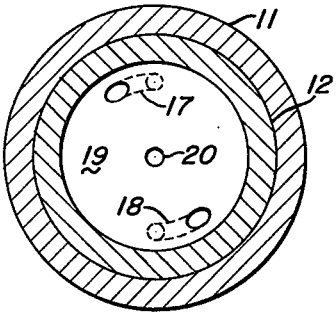

LIQUID PROPELLANT/REGENERATIVE CHARGING SYSTEM BUBBLE PREVENTER

RIGHTS OF THE GOVERNMENT

The invention described herein may be manufactured and used by or for the Government of the United States for all governmental purposes without the payment of any royalty.

BACKGROUND OF THE INVENTION

Guns having projectiles propelled by the combustion of liquid propellants are well known. Regenerative liquid propellant feed systems wherein the combustion forces are used to force additional liquid propellant into the combustion chamber are also known. U.S. Pat. No. 2,981,153 to patentees Wilson et al is a typical example of applicable prior art. The regenerative liquid propellant feed system is attractive for very high pressure combustion systems that fire repetitively, such as a gun. Air and/or vapor bubbles in the propellant charge however have posed two serious problems: (1) they are a source of variation in the weight of propellant charged from round to round; and (2) if a monopropellant is used the temperature rise due to adiabatic compression of the bubble may initiate an explosive decomposition behind the piston.

It has been found that bubbles in the charge can substantially be avoided by admitting the propellant in a tangential direction into a cylindrical or annular charge chamber. The swirling of the fuel input to the combustion chamber of jet engines is known as exemplified by U.S. Pat. Nos. 3,355,891 to patentee Rhodes, and 3,426,534 to patentee Murphy. Since this swirling of the fuel is into the combustion chamber and not into a charge chamber, and since these patents are to the jet engine art and not the gun art they are not considered prior art in the field of the invention.

SUMMARY OF THE INVENTION

By introducing a liquid propellant in a tangential direction into the cylindrical charge chamber of a liquid propellant gun and venting the charge chamber from the center during the charging sequence provides a discharge of trapped gases by the centrifugal force created by the swirling flow of the propellant forcing bubbles toward the center and out the vent.

BRIEF DESCRIPTION OF THE DRAWING

FIG. 1 is a schematic representation of a longitudinal section of a liquid propellant gun illustrating an embodiment of the invention; and FIG. 2 is a schematic representation of a cross section of a liquid propellant gun illustrating an embodiment of the invention.

DESCRIPTION OF THE PREFERRED EMBODIMENT

Referring to the figures of the drawing, the liquid propellant gun has chamber wall 11, with floating piston 12. Floating piston 12 and the face of breech plug 19 define the charge chamber 13 into which the propellant liquid is forced by conventional pump 14. Conventional valving 15, and 16 conventionally control the flow of fuel into the charge chamber and the venting of the chamber, respectively.

The invention comprises the fabricating of the fuel inlet tubes 17 and 18 in the chamber breech plug 19 so that the fuel is injected into chamber 13 in substantially a tangential direction to the cylindrical inner wall. This is accomplished by angling the inlet tubes as they exit from the plug 19 into the charge chamber 13. This provides a swirling flow to the propellant going into the charging chamber, compacting the liquid toward the piston wall, and as the charging chamber fills forcing any entrapped air in the chamber and in bubbles in the liquid toward the center of the chamber and out the central axis vent 20. Thus, when pure propellant liquid emerges the vent outlet 21, the chamber 13 is completely filled with propellant devoid of any air bubbles. The entry angle of the propellant into the charge chamber 13 is not critical. Entry angles from 20 to 60 degrees will generally be suitable with the shallower angles generally more suited for higher propellant velocities and higher rate of fire guns. Ideally, the propellant velocities (pump pressures) and fire rates are balanced so that a minimum of propellant liquid is lost out the vent 21 before the closing of the valves and the firing of the gun.

I claim:

1. The improvement in the charging of cylindrical charging chamber of a rapid fire liquid propellant gun having liquid propellant introduced into the charging chamber through inlet and vent tubes traversing the breech plug, said improvement for removing entrapped gas in the liquid propellant comprising fabricating the said inlet tubes in the said breech plug at an angle and positioning the vent tube substantially on the central axis of the plug whereby the said liquid propellant is injected into the said charging chamber in substantially a tangential direction to the cylindrical inner wall of the said charging chamber and exhausting the said gas out the said vent.

* * * * *